US007040120B2

(12) United States Patent
Hunter

(10) Patent No.: US 7,040,120 B2
(45) Date of Patent: May 9, 2006

(54) FLEXIBLE PIECE OF JEWELRY

(76) Inventor: Roxanne A. Hunter, 1122 Sunnyside Dr., Cadillac, MI (US) 49601

( * ) Notice: Subject to any disclaimer, the term of this patent is extended or adjusted under 35 U.S.C. 154(b) by 51 days.

(21) Appl. No.: 10/405,023

(22) Filed: Apr. 1, 2003

(65) Prior Publication Data

US 2003/0233845 A1 Dec. 25, 2003

Related U.S. Application Data

(60) Provisional application No. 60/391,547, filed on Jun. 25, 2002.

(51) Int. Cl.
*A44C 5/02* (2006.01)

(52) U.S. Cl. ..... 63/4; 63/9; 63/38; 63/40; 59/78; 59/79.2; 59/80

(58) Field of Classification Search ..... 59/3, 59/80, 82–85, 87, 90, 93, 78, 79.2; 63/4, 63/21–23, 18, 19, 3, 40, 9, 38
See application file for complete search history.

(56) References Cited

U.S. PATENT DOCUMENTS

| | | | | | |
|---|---|---|---|---|---|
| 330,214 | A * | 11/1885 | Egge | 59/91 |
| 2,047,129 | A * | 7/1936 | Randall | 24/564 |
| 2,138,596 | A * | 11/1938 | Fassnacht | 63/23 |
| 2,355,944 | A * | 8/1944 | Beggs | 59/83 |
| 3,386,240 | A * | 6/1968 | Blumstein | 59/78 |
| 3,733,852 | A * | 5/1973 | Johnson et al. | 63/37 |
| 3,877,250 | A * | 4/1975 | Musillo | 63/23 |
| 4,282,733 | A * | 8/1981 | Schmitt (Johnston) | 70/456 R |
| 5,516,114 | A * | 5/1996 | Michlin et al. | 273/400 |
| 5,553,363 | A * | 9/1996 | Chen | 24/353 |
| 6,223,559 | B1 * | 5/2001 | Coleman | 63/1.13 |

OTHER PUBLICATIONS

NHOM.org <http://www.nhom.org/results/1999/wolds99/spoil-dinner.htm> from Jul. 24, 2001.*

* cited by examiner

*Primary Examiner*—Jack W. Lavinder

(57) ABSTRACT

A flexible piece of jewelry, such as a charm bracelet or necklace, that utilizes non-continuous chain links that constitute the continuous chain of the piece of jewelry. This link design allows more non-continuous links to be added to the bracelet as the child grows and the need for a larger piece of jewelry evolves and minimizes damage to the piece of jewelry caused by the addition of additional charms or links.

6 Claims, 1 Drawing Sheet

FLEXIBLE PIECE OF JEWELRY

CROSS REFERENCE TO RELATED APPLICATION

The present application claims priority from U.S. provisional application Ser. No. 60/391,547, filed Jun. 25, 2002, and entitled "A Flexible Charm Bracelet."

TECHNICAL FIELD

The present invention relates generally to jewelry and more specifically to flexible pieces of jewelry.

BACKGROUND OF THE INVENTION

Current charm bracelets are well known. However, in order to add a charm to most current bracelets, a wearer must take the bracelet to a jeweler who will then secure the additional charm thereto, such as through standard soldering methods. This can also require the bracelet to be left with the jeweler. Unfortunately, for many people it can take a good deal of time before they actually get around to taking the bracelet to the jeweler to have the charm added, which can result in loss of full enjoyment of the bracelet with the attached additional charm. Further, soldering also can be disadvantageous because the charm can become separated from the bracelet and lost if the solder joint is weak. This can significantly diminish the sentimental value of the bracelet.

It is thus highly desirable to provide a charm bracelet that allows individuals to easily and securely add charms to a bracelet without the need to take the bracelet to a jeweler. It is also desirable that these charms can be added without the need to damage the bracelet. It would also be desirable to have the ability to add charm links to a charm bracelet easily as the need for a larger bracelet evolves or as additional charms are acquired.

SUMMARY OF THE INVENTION

It is therefore an object of the present invention to provide a piece of jewelry that is flexible in that it allows for charms to be readily added without the need to take the piece of jewelry to the jeweler.

It is a further object of the present invention to provide a piece of jewelry that minimizes separation of a charm from the bracelet, by providing a more secure attachment.

In one preferred embodiment, the continuous chain of the piece of jewelry is formed from a plurality of non-continuous bracelet links. Charms are added to one or more of the non-continuous links to form the charm bracelet. This link design allows more non-continuous links to be added to the bracelet as the child grows and the need for a larger bracelet evolves.

The non-continuous bracelet links can take on a variety of shapes, including triangular, circular, square, figure eight shaped or oval. Moreover, the links can be utilized for other pieces of jewelry besides bracelets.

Other objects and advantages of the present invention will become apparent upon considering the following detailed description and appended claims, and upon reference to the accompanying drawings.

DETAILED DESCRIPTION AND PREFERRED EMBODIMENTS OF THE INVENTION

Figure 1:
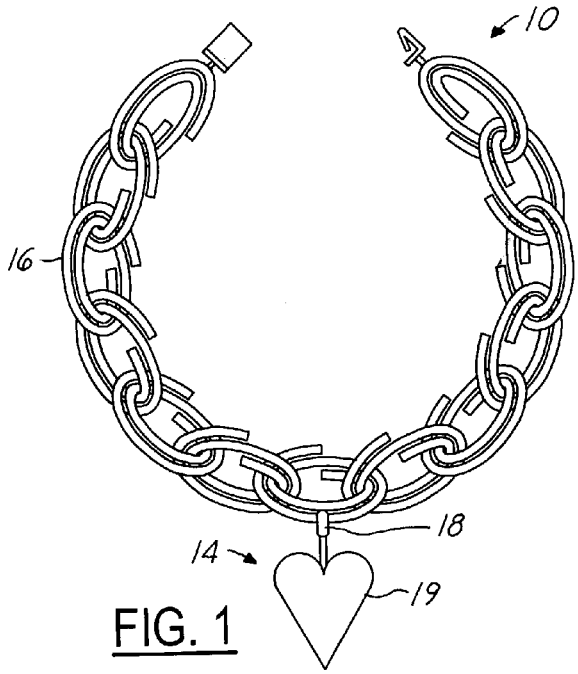
FIG. 1 is a perspective view of a flexible charm bracelet according to a preferred embodiment of the present invention.
Figure 2:
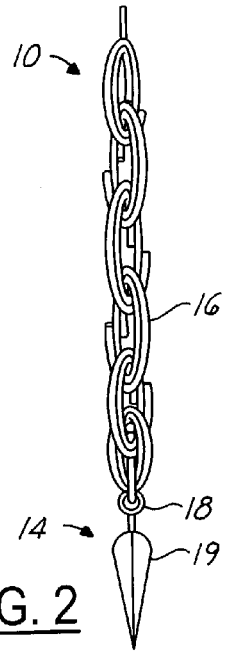
FIG. 2 is a side view of FIG. 1.

Referring now to FIGS. 1 and 2, a flexible piece of jewelry, here a charm bracelet, according to a preferred embodiment of the present invention is shown and generally identified by reference numeral 10. The charm bracelet 10 consists of a plurality of non-continuous links 16, which form a continuous chain. The continuous chain is formed by coupling each individual non-continuous link 16 on either side to an adjacent pair of non-continuous links 16 to form the continuous chain. While the shape of each individual non-continuous link 16 is shown herein as being substantially oval shaped, it is understood that the shape of the non-continuous links 16, for purposes of the present invention, is not important and can vary as described below.

Also shown in FIGS. 1 and 2, the bracelet 10 includes a charm 14 having an eyelet portion 18 and a charm portion 19. The eyelet portion is then reversibly coupled to one of the non-continuous links 16. The design of the charm portion 19 may take on many forms having sentimental value to the wearer as is appreciated by those of ordinary skill in the art. It will also be understood that more than one charm 14 can be attached to the bracelet 10.

Figure 3:
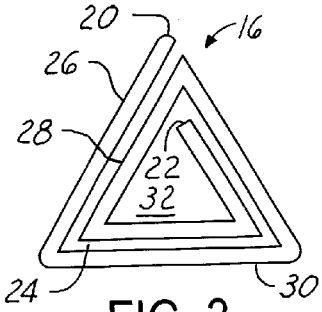
FIG. 3 is a perspective view of a non-continuous link for a charm bracelet according to a preferred embodiment of the present invention.

As best shown in FIG. 3, the non-continuous link 16 is a continuous wire-like segment forming a geometric perimeter. The non-continuous link thus has a first, or outer end 20, and a second, or inner end 22. An overlapping region 24 is defined between a closely coupled outer segment 26 and an inner segment 28 of the continuous wire. A middle region 30 is also defined within the overlapping region 24 that is located approximately in the middle of the overlapping region 24 and preferably midway along the length of the continuous wire between the inner end 22 and outer end 20. A center region 32 is defined within the inner surface of the inner segment 28.

The non-continuous link 16 may be formed of many metal materials, including precious metals such as gold, silver, or platinum. The links 16 may also be formed of strong, pliant non-metallic materials such as plastic. The links 16 can also be formed of a variety of other suitable materials. Further, the cross-sectional shape of the segments of the link 16 may take on a wide of shapes.

The charm 14 is introduced to the non-continuous link 16 by introducing the eyelet 18 around the outer end 20 of the non-continuous chain 16 and sliding it along the outer segment 26 towards the middle region 30. The eyelet 18 is then slid along the closely coupled outer segment 26 and into the overlapping region 24 to retain the eyelet 18. As this occurs, the inner segment 28 is forced inward by the eyelet 18 towards the center region 32 and away from the outer segment 26. The eyelet 18 continues to move along the outer segment 26 to the middle region 30. The charm 14 is then reversibly retained within the middle region 30 between the inner segment 28 and the outer segment 26 of the non-continuous link 16.

To remove the charm 14 from the non-continuous link 16, simply reverse the process by moving the eyelet 18 from the middle region 30 along the outer segment 26 towards the outer end 20. The eyelet 18 then moves towards the outer end 20 and off of the non-continuous link 16, at which time the inner segment 28 springs back towards the outer segment 26.

Alternatively, the charm 14 could be introduced to the non-continuous link 16 by introducing the eyelet 18 around the inner end 22 of the non-continuous chain 16 and sliding it along the inner segment 26 and into the overlapping region 24. As this occurs, the outer segment 26 is forced outward away from the center region 32 and the inner segment 28. The eyelet continues to move along the inner segment 28 to the middle region 30. The charm 14 is then reversibly retained within the middle region 30 between the inner segment 28 and outer segment 26 of the non-continuous link 16.

Figure 4:
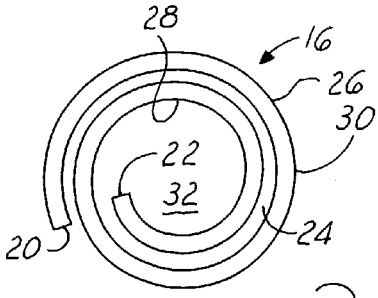
FIGS. 4 through 7 illustrate alternative embodiments of non-continuous links that may be used in addition to or in place of the non-continuous link of FIGS. 1 through 3.
Figure 7:
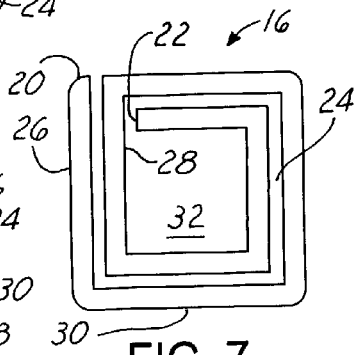
Figure 5:
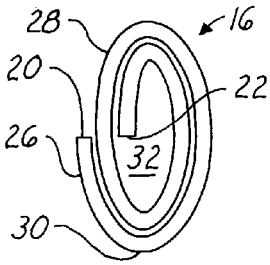
Figure 6:
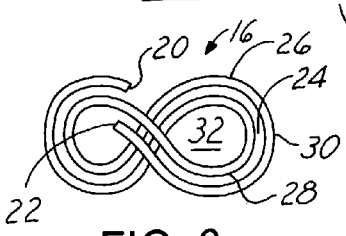

While the non-continuous link 16, as shown in FIGS. 1 through 3, is illustrated as being substantially triangular shaped, the overall design of the non-continuous link 16 may take on many different geometric and non-geometric configurations, as one of ordinary skill in the art would recognize. For example, as shown in FIG. 4, the non-continuous link 16 may be circular. Similarly, as shown in FIG. 5, the non-continuous link 16 is illustrated as oval shaped or, as shown in FIG. 6, the non-continuous link may have a FIG. 8 configuration, or, as shown in FIG. 7, the non-continuous link 16 may be square shaped.

The method for coupling non-continuous links 16 together accomplished by first reversibly securing one non-continuous link to an adjacent non-continuous link 16 by pressing a portion of one of the non-continuous links 16 between the outer segment 26 and the inner segment 28 of the overlapping region 24 at a location near the outer end 20 of an adjacent non-continuous link 16. At this point, the outer segment 26 and inner segment 28 move away from each other and define an open position. The link 16 is then passed through the middle region 30 and towards the inner end 22. The link 16 then passes out of the overlapping region 24 at the inner end 22 and into the central region 32. The non-continuous link 16 is then retained within the central region 32 of the adjacent non-continuous link 16. The process is then repeated by reversibly coupling another non-continuous link 16 to one of the two reversibly coupled links 16 to form a chain of reversibly coupled links 16. The end links, or first and second outermost non-continuous links 16, of the chain are then reversibly coupled with each other to form a continuous chain.

The overall size of the flexible charm bracelet 50 thus depends upon the number of reversibly coupled links 16 coupled within the continuous chain. To increase the size of the charm bracelet 50 of FIG. 1, adjacent links 16 in the continuous chain are uncoupled and an additional non-continuous link 16 is added between the two uncoupled adjacent links 16 to form a new larger continuous chain. Similarly, to decrease the size of the charm bracelet 50, simply reverse the process.

As one of ordinary skill would thus appreciate, the present invention introduces a simple method for adding or removing charms 14 from a charm bracelet or for increasing or decreasing the size of a charm bracelet easily and quickly without the use of a jeweler. Further, the non-continuous link 16 design addresses problems in the prior art associated with physically damaging the charm bracelet in order to add additional charms.

Further, while the invention as described in FIGS. 1–6 above depict a charm bracelet, it is understood by those of ordinary skill that the non-continuous link design may be used in forming other kinds of jewelry. For example, a charm necklace may be formed from the non-continuous links 16 and charms 14 as described in FIGS. 1–6. Also, the present invention may be incorporated into other items of interest not specifically related to the jewelry industry. For example, industrial chain applications may utilize one or more of the non-continuous links 16 described above.

While the invention has been described in terms of preferred embodiments, it will be understood, of course, that the invention is not limited thereto since modifications may be made by those skilled in the art, particularly in light of the foregoing teachings.

What is claimed is:

1. A flexible piece of jewelry comprising:

a continuous chain comprising a plurality of non-continuous chain links, wherein each of said plurality of said non-continuous chain links comprises a continuous wire-like segment having an outer end, an outer segment extending from said outer end, an inner end, and an inner segment extending from said inner end and defining a central region, said inner segment being closely coupled to said outer segment and defining an overlapping region, said continuous wire-like segment extending from said outer end to said inner end;

wherein each non-continuous chain link of said plurality of non-continuous chain links is coupled at either end to an adjacent one of said plurality of non-continuous chain links; and a charm reversibly coupled onto and around said continuous wire-like segment of one of plurality of said non-continuous links at either said inner end or said outer end and within said overlapping region such that said charm displaces said inner segment away from said outer segment and towards said central region.

2. The flexible piece of jewelry of claim 1, wherein said non-continuous link comprises a continuous wire-like segment having a first geometric shape.

3. The flexible piece of jewelry of claim 2, wherein said first geometric shape is selected from the group consisting of oval shaped, round shaped, square shaped, triangular shaped and figure eight shaped.

4. The flexible bracelet of claim 1, wherein said charm comprises an eyelet portion and a charm portion.

5. The flexible bracelet of claim 4, wherein said eyelet portion is reversibly coupled onto and around said continuous wire-like segment of one of plurality of said non-continuous links at either said inner end or said outer end and within said overlapping region such that said eyelet portion displaces said inner segment away from said outer segment and towards said central region.

6. The flexible bracelet of claim 1, wherein each non-continuous chain link of said plurality of non-continuous chain links is reversibly coupled at either end to an adjacent one of said plurality of non-continuous chain links.

* * * * *

UNITED STATES PATENT AND TRADEMARK OFFICE

CERTIFICATE OF CORRECTION

PATENT NO. : 7,040,120 B2
APPLICATION NO. : 10/405023
DATED : May 9, 2006
INVENTOR(S) : Roxanne M. Hunter It is certified that error appears in the above-identified patent and that said Letters Patent is hereby corrected as shown below:

Insert item [76], Inventor's Middle Initial: Delete "A." replace with "M."

Signed and Sealed this

Eighteenth Day of July, 2006

JON W. DUDAS
*Director of the United States Patent and Trademark Office*